US011482123B2

(12) United States Patent
Katz

(10) Patent No.: US 11,482,123 B2
(45) Date of Patent: Oct. 25, 2022

(54) SENSOR ENHANCED REAL TIME AUTOMATIC PILOT REPORT (PIREP) GENERATION

(71) Applicant: Rockwell Collins, Inc., Cedar Rapids, IA (US)

(72) Inventor: Aryeh Katz, Baltimore, MD (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 49 days.

(21) Appl. No.: 17/001,416

(22) Filed: Aug. 24, 2020

(65) Prior Publication Data

US 2022/0058967 A1 Feb. 24, 2022

(51) Int. Cl.
*G08G 5/00* (2006.01)

(52) U.S. Cl.
CPC ..... *G08G 5/0091* (2013.01); *G08G 5/003* (2013.01); *G08G 5/0013* (2013.01)

(58) Field of Classification Search
CPC ..... G08G 5/0091; G08G 5/0013; G08G 5/003
See application file for complete search history.

(56) References Cited

U.S. PATENT DOCUMENTS 6,278,913 B1 8/2001 Jiang
6,633,801 B1 * 10/2003 Durlacher ..... G08G 5/0021 701/14
6,828,922 B1 * 12/2004 Gremmert ..... G01S 7/003 342/26 B
7,463,955 B1 12/2008 Robinson et al.
(Continued)

FOREIGN PATENT DOCUMENTS

CA 2989107 A1 * 9/2018 ..... B64D 43/00
CN 105427673 A * 3/2016 ..... G01C 21/00
(Continued)

OTHER PUBLICATIONS

"Sensors and systems to enhance aviation safety against weather hazards;" P.R. Mahapatra, D.S. Zrnic; Proceedings of the IEEE (vol. 79, Issue: 9, pp. 1234-1267); Sep. 1, 1991. (Year: 1991).*
(Continued)

*Primary Examiner* — Khoi H Tran
*Assistant Examiner* — Jorge O Peche
(74) *Attorney, Agent, or Firm* — Suiter Swantz pc llo

(57) ABSTRACT

A system and method for sensor-enhanced real-time automatic pilot report (PIREP) generation is disclosed. In embodiments, the PIREP generation system includes control processors in communication with a variety of aircraft-based sensors. Diverse sensors collect atmospheric data of meteorological conditions in the vicinity of the aircraft and/or its flight path. The PIREP generating system analyzes the collected datasets and determines whether the collected datasets meet criteria for reportable weather conditions. Reportable data are displayed to the pilot via an interactive display device whereby the pilot may accept, abort (e.g., opt out), or augment the data with additional information provided by the pilot. If the pilot aborts the PIREP, no further action is taken. Otherwise (e.g., if the pilot accepts, augments, or takes no action), a PIREP is automatically generated based on the displayed (or amended) reportable data. The generated PIREP is automatically transmitted to ground control.

13 Claims, 4 Drawing Sheets

(56) References Cited

U.S. PATENT DOCUMENTS

| | | | | |
|---|---|---|---|---|
| 7,471,995 | B1 | 12/2008 | Robinson | |
| 8,131,407 | B1 | 3/2012 | Robinson | |
| 8,874,288 | B1 * | 10/2014 | Siddiqui | G08G 5/0021 701/1 |
| 10,276,050 | B2 * | 4/2019 | Reinke | B64D 45/00 |
| 10,296,179 | B2 | 5/2019 | Nama et al. | |
| 10,467,913 | B1 * | 11/2019 | Suiter | G08G 5/025 |
| 10,529,242 | B2 | 1/2020 | Shamasundar et al. | |
| 2002/0039072 | A1 * | 4/2002 | Gremmert | G08G 5/0052 340/963 |
| 2004/0183695 | A1 * | 9/2004 | Ruokangas | G08G 5/0091 455/414.3 |
| 2004/0246145 | A1 * | 12/2004 | Andrews | G01C 5/005 340/626 |
| 2006/0129286 | A1 * | 6/2006 | King | G01C 23/005 701/4 |
| 2010/0042275 | A1 * | 2/2010 | Kirk | G01W 1/04 701/14 |
| 2010/0315265 | A1 * | 12/2010 | Smith | G08G 5/0013 340/963 |
| 2011/0187588 | A1 * | 8/2011 | Khatwa | G08G 5/0091 342/26 B |
| 2012/0218127 | A1 * | 8/2012 | Kroen | G08G 5/0052 340/945 |
| 2013/0120166 | A1 | 5/2013 | Kommuri et al. | |
| 2013/0226452 | A1 * | 8/2013 | Watts | G01C 21/3407 701/528 |
| 2013/0245860 | A1 | 9/2013 | Cooper | |
| 2014/0028476 | A1 | 1/2014 | Kolbe et al. | |
| 2015/0088342 | A1 * | 3/2015 | Conner | G08G 5/0078 701/14 |
| 2016/0133137 | A1 * | 5/2016 | Rencher | G08G 5/0021 701/537 |
| 2016/0293021 | A1 * | 10/2016 | Shipley | G08G 5/0052 |
| 2017/0345318 | A1 * | 11/2017 | Kim | B64D 45/00 |
| 2018/0253982 | A1 * | 9/2018 | Shamasundar | B64D 43/00 |
| 2019/0304314 | A1 * | 10/2019 | Hochwarth | G08G 5/0091 |
| 2020/0103550 | A1 * | 4/2020 | Ruwe | H04R 1/028 |
| 2020/0258403 | A1 * | 8/2020 | Rathi | G01S 13/953 |
| 2020/0334994 | A1 * | 10/2020 | Jensen | G08G 5/0021 |
| 2021/0001998 | A1 * | 1/2021 | Miller | G01N 33/007 |
| 2021/0358314 | A1 * | 11/2021 | Hwu | G08G 5/0021 |
| 2021/0383708 | A1 * | 12/2021 | Gibbons, II | G08G 5/0013 |
| 2022/0013022 | A1 * | 1/2022 | He | G08G 5/0013 |

FOREIGN PATENT DOCUMENTS

| | | | | |
|---|---|---|---|---|
| EP | 2821752 | A1 | 1/2015 | |
| EP | 2933663 | A2 * | 10/2015 | G01S 13/951 |
| EP | 3220170 | A1 * | 9/2017 | G01C 21/20 |
| EP | 3293553 | A1 * | 3/2018 | G01C 21/3691 |
| EP | 3370218 | A1 * | 9/2018 | B64D 43/00 |
| EP | 3370218 | A1 | 9/2018 | |
| FR | 2979427 | A1 | 3/2013 | |
| JP | 5255857 | B2 * | 8/2013 | G01W 1/10 |
| WO | WO-2014106268 | A1 * | 7/2014 | B64D 15/00 |
| WO | WO-2014106269 | A1 * | 7/2014 | B64D 15/00 |
| WO | WO-2014106273 | A1 * | 7/2014 | G08G 5/0013 |
| WO | WO-2015037375 | A1 * | 3/2015 | B64D 45/04 |
| WO | WO-2015095890 | A1 * | 6/2015 | G01W 1/00 |

OTHER PUBLICATIONS

"Weather Hazard Requirements for NGATS Aircraft;" J. Krozel, J.T. Murphy; 2007 Integrated Communications, Navigation and Surveillance Conference (pp. 1-12); Jan. 28, 2008. (Year: 2008).*

Aerotech Research (U.S.A.), Inc., Turbulence Auto-PIREP System (TAPS(r)), http://www.atr-usa.com/sub_pages/taps.html, Print Date Aug. 24, 2020, 2 pages, (c) 2016 AeroTech Research (U.S.A.), Inc., United States.

Wikipedia, the Free Encyclopedia, Aircraft Meteorological Data Relay, https://en.wikipedia.org/wiki/Aircraft_Meteorological_Data_Relay, Apr. 6, 2020, 1 page, Wikipedia, Print Date Aug. 24, 2020.

Wikipedia, the Free Encyclopedia, TAMDAR, https://en.wikipedia.org/wiki/TAMDAR, Nov. 18, 2019, 5 pages, Wikipedia, Print Date Aug. 24, 2020.

Extended Search Report in European Application No. 21192205.9 dated Jan. 26, 2022, 11 pages.

* cited by examiner

SENSOR ENHANCED REAL TIME AUTOMATIC PILOT REPORT (PIREP) GENERATION

TECHNICAL FIELD

The subject matter disclosed by the instant application is directed generally to avionics and more particularly to airborne observation and reporting of weather conditions.

BACKGROUND

Pilots of commercial and civil aircraft alike depend on weather information to ensure safe flight (or to determine whether they should fly at all); generally weather information is provided by originating and destination airports and/or any other ground-based control facilities that may be in or near the aircraft's flight path. For this weather information to be truly useful to pilots, however, it must be timely, localized, and frequent enough to track meteorological events with enough accuracy so that pilots may anticipate and react to such events before encountering them (e.g., preplanning a flight path to avoid likely areas of turbulence, or changing the flight path to evade detected or potential areas of turbulence once inflight).

One way of achieving this degree of timeliness and localization are pilot reports (PIREP). PIREPs provide a sort of open-source weather data by allowing pilots to report any meteorological events they encounter to ground control facilities, which may then pass the reports on to other aircraft in the vicinity. However, generally PIREPs must be manually generated by air traffic control (ATC) in collaboration with the pilot (e.g., after verbal communication with the pilot), and thus few pilots reliably provide current and relevant weather data inflight. Further, conventional attempts to automate pilot reporting are either limited in scope (e.g., focusing on identifying and reporting turbulence) or do not contribute to more frequent, frictionless weather reporting (e.g., opt-in systems that require pilot intervention to generate or transmit PIREPS).

SUMMARY

A sensor-enhanced real-time automatic pilot report (PIREP) generating system is disclosed. In embodiments, the PIREP generating system includes control processors in communication with a variety of aircraft-based sensors. The PIREP generating system collects from the aircraft-based sensors sets of atmospheric and meteorological data of the vicinity of the aircraft and/or its flight path. The PIREP generating system analyzes the collected datasets and determines whether the collected datasets meet criteria for reportable weather conditions. Reportable data are displayed to the pilot via an interactive display device whereby the pilot may accept, abort (e.g., opt out), or augment the data with additional information provided by the pilot. If the pilot aborts the PIREP, no further action is taken. Otherwise (e.g., if the pilot accepts, augments, or takes no action), a PIREP is automatically generated based on the displayed (or amended) reportable data. The generated PIREP is automatically transmitted to ground-based control facilities.

In some embodiments, the PIREP generating system includes a timer for activating a countdown when the reportable data are displayed to the pilot; if the timer expires and the pilot has not opted out, the PIREP automatically generates.

In some embodiments, the reportable atmospheric data and any amendments thereto provided by the pilot are displayed in a text format.

In some embodiments, the collected atmospheric data include a first, or initial dataset, and one or more second, or subsequent, datasets. The criteria for reportability may provide that conditions are reportable based on either a threshold change in conditions between the initial and subsequent datasets (e.g., normal to severe, severe to normal) or a persistence in reportable (e.g., severe, significant) conditions from the initial to the subsequent dataset.

In some embodiments, the initial and subsequent datasets are based on or classified by initial and subsequent timestamps.

In some embodiments, the initial and subsequent datasets are based on or classified by initial and subsequent locations of the aircraft.

In some embodiments, the initial and subsequent locations of the aircraft correspond to initial and subsequent altitudes of the aircraft (e.g., as the aircraft climbs or descends).

In some embodiments, the displayed reportable atmospheric data includes data elements predicted by the PIREP generation system, e.g., based on observed atmospheric conditions or multiple sensor feeds.

A method for sensor-enhanced real-time automatic pilot report (PIREP) generation is also disclosed. In embodiments, the method includes receiving datasets of atmospheric or meteorological conditions in the vicinity of an aircraft from diverse aircraft-based sensors. The method includes determining, via a PIREP generating system, whether the atmospheric data comprise reportable atmospheric conditions based one or more reporting criteria. The method includes displaying the reportable atmospheric data to the aircraft pilot via an interactive display device. The method includes accepting, via the display device, control input from the pilot, the control input including either an opt-out from PIREP generation or an acceptance of the reportable data (including augmentation or amendment of the displayed data by the pilot). The method includes, if the pilot does not opt out or reject the displayed reportable data (e.g., if the pilot accepts, amends, or does nothing), automatically generating a PIREP based on the displayed reportable data. The method includes transmitting the generated PIREP to ground-based control facilities.

In some embodiments, the method includes activating a countdown timer upon displaying the reportable data, and generating the PIREP if the countdown timer expires without the pilot having rejected the displayed data.

In some embodiments, the method includes, if the pilot amends the reportable data, generating the PIREP based on the amended data.

In some embodiments, the method includes collecting one or more first atmospheric datasets via a first sensor and one or more second atmospheric datasets via a different sensor. The method includes generating, with the collected reportable data, predictive data elements based on sensor fusion of the first and second datasets.

In some embodiments, the method includes collecting a first or initial dataset and a second or subsequent dataset, and for the determination of reportable conditions based on either a significant change between the initial and subsequent datasets (e.g., normal to severe conditions, or severe to normal conditions) or on a persistence of severe, significant, or otherwise reportable conditions from the initial to the subsequent dataset.

In some embodiments, the method includes collecting initial and subsequent datasets based on an initial timestamp and a subsequent timestamp.

In some embodiments, the method includes collecting initial and subsequent datasets based on an initial location or altitude of the aircraft and a subsequent location of the aircraft (e.g., as the aircraft traverses its flightpath and/or climbs/descends).

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims. In the drawings:

DETAILED DESCRIPTION

Figure 1:
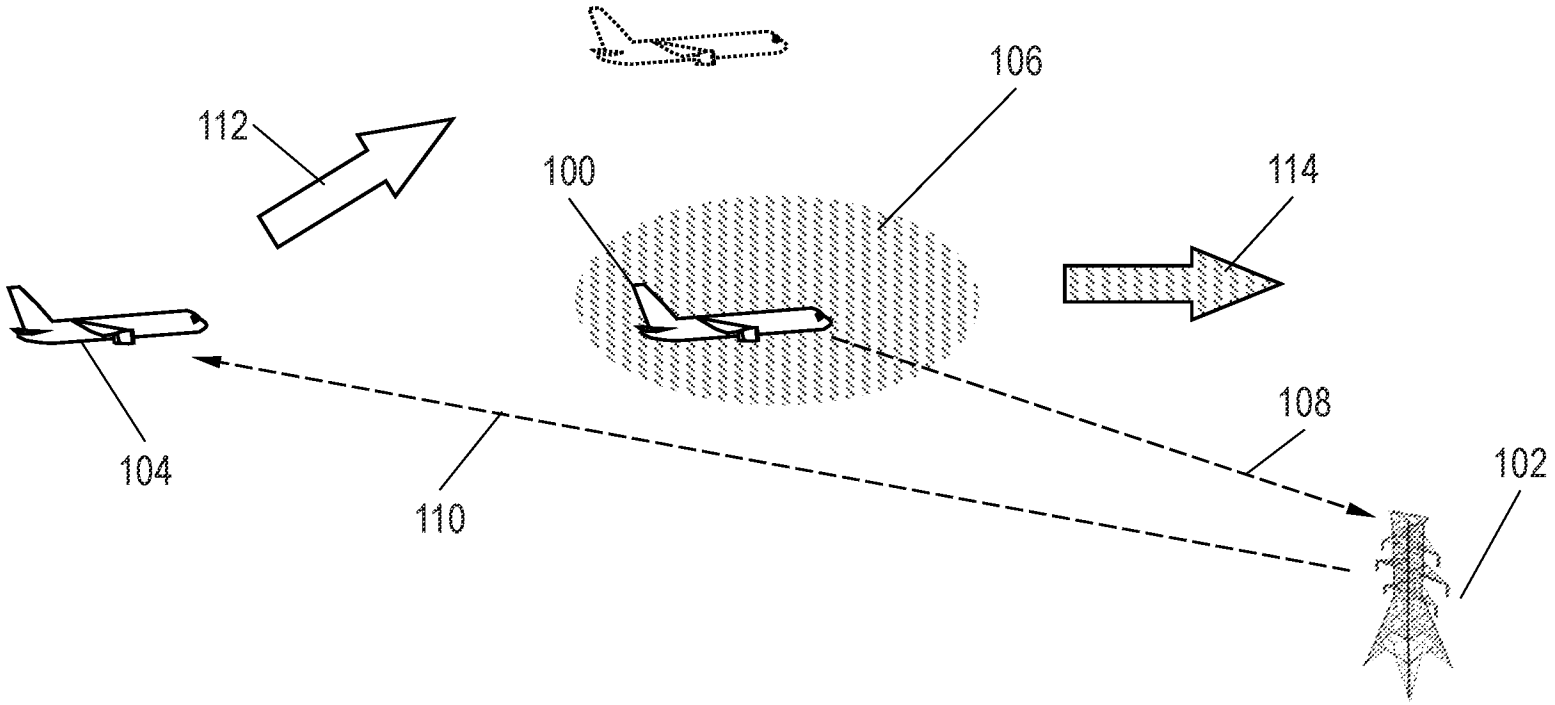
FIG. 1 is a diagrammatic illustration of an aircraft configured for sensor-enhanced real-time automatic PIREP generation according to example embodiments of this disclosure.

Before explaining one or more embodiments of the disclosure in detail, it is to be understood that the embodiments are not limited in their application to the details of construction and the arrangement of the components or steps or methodologies set forth in the following description or illustrated in the drawings. In the following detailed description of embodiments, numerous specific details may be set forth in order to provide a more thorough understanding of the disclosure. However, it will be apparent to one of ordinary skill in the art having the benefit of the instant disclosure that the embodiments disclosed herein may be practiced without some of these specific details. In other instances, well-known features may not be described in detail to avoid unnecessarily complicating the instant disclosure.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination or sub-combination of two or more such features, along with any other features which may not necessarily be expressly described or inherently present in the instant disclosure.

Referring to FIG. 1, an aircraft 100 is disclosed. The aircraft 100 may be proximate to a ground-based facility 102 and may be followed by a proximate aircraft 104 (e.g., the proximate aircraft 104 may be following a time-divided flight plan identical or similar to that of the aircraft 100, such that the proximate aircraft may be proximate to the ground-based facility some time after the aircraft 100 passes thereby).

In embodiments, the aircraft 100 may incorporate a sensor-enhanced real-time automatic pilot report (PIREP) generation system. For example, the aircraft 100 may incorporate a variety of onboard sensors configured for continual observation of weather and atmospheric conditions in the immediate vicinity of the aircraft, e.g., atmospheric pressure, air temperature, humidity. Based on these weather and atmospheric conditions, either alone or in combination, meteorological events 106 may occur within the flight path of the aircraft 100. For example, the aircraft 100 may be subject to icing, turbulence, precipitation, changing wind patterns (e.g., headwinds, tailwinds, crosswinds), wind shear, or other such meteorological events 106 that may affect its flight plan in minor (e.g., minor crew or passenger discomfort) or significant ways (e.g., requiring a change of flight plan or even an emergency landing). Even if the meteorological events 106 are not actually encountered by the aircraft 100, atmospheric conditions may exist to make such events possible or imminent, such that the proximate aircraft 104, following a similar flight plan to the aircraft 100, may encounter the meteorological events without advance warning or knowledge.

In embodiments, the PIREP generation system aboard the aircraft 100 may automatically determine the existence of the meteorological event 106 (or sufficient conditions to make such an event possible or imminent) and generate a PIREP documenting the meteorological event or its supporting conditions, transmitting the PIREP (108) to the ground-based facility 102 without the need for pilot intervention. The ground-based facility 102 may subsequently forward the PIREP (110) to the proximate aircraft 104; the proximate aircraft, having knowledge of the meteorological event 106, may climb (112) to evade the meteorological event. In some embodiments the ground-based facility 102 may, based on multiple PIREPs received from multiple aircraft at multiple data points (e.g., each PIREP associated with a known position and a timestamp) make predictions as to meteorological or atmospheric conditions in the vicinity of the ground-based facility, e.g., the movement (114) of the meteorological event 106.

In some embodiments, as disclosed in greater detail below (see, e.g., FIG. 3 and accompanying text), the PIREP generation system may periodically generate PIREPs, or reportable data for presentation to the pilot prior to PIREP generation, based on the persistence of meteorological events 106 over time, or as the aircraft 100 changes position or altitude. Additionally, or alternatively, the PIREP generation system may generate PIREPs or reportable data based on a change of atmospheric conditions in any direction, e.g., the appearance of meteorological events 106 where weather conditions may otherwise be nominal or a reversion to nominal weather conditions based on changes in position or altitude (e.g., if the aircraft 100, having encountered the meteorological event 106, climbs to evade the event and reaches less turbulent air).

Figure 2:
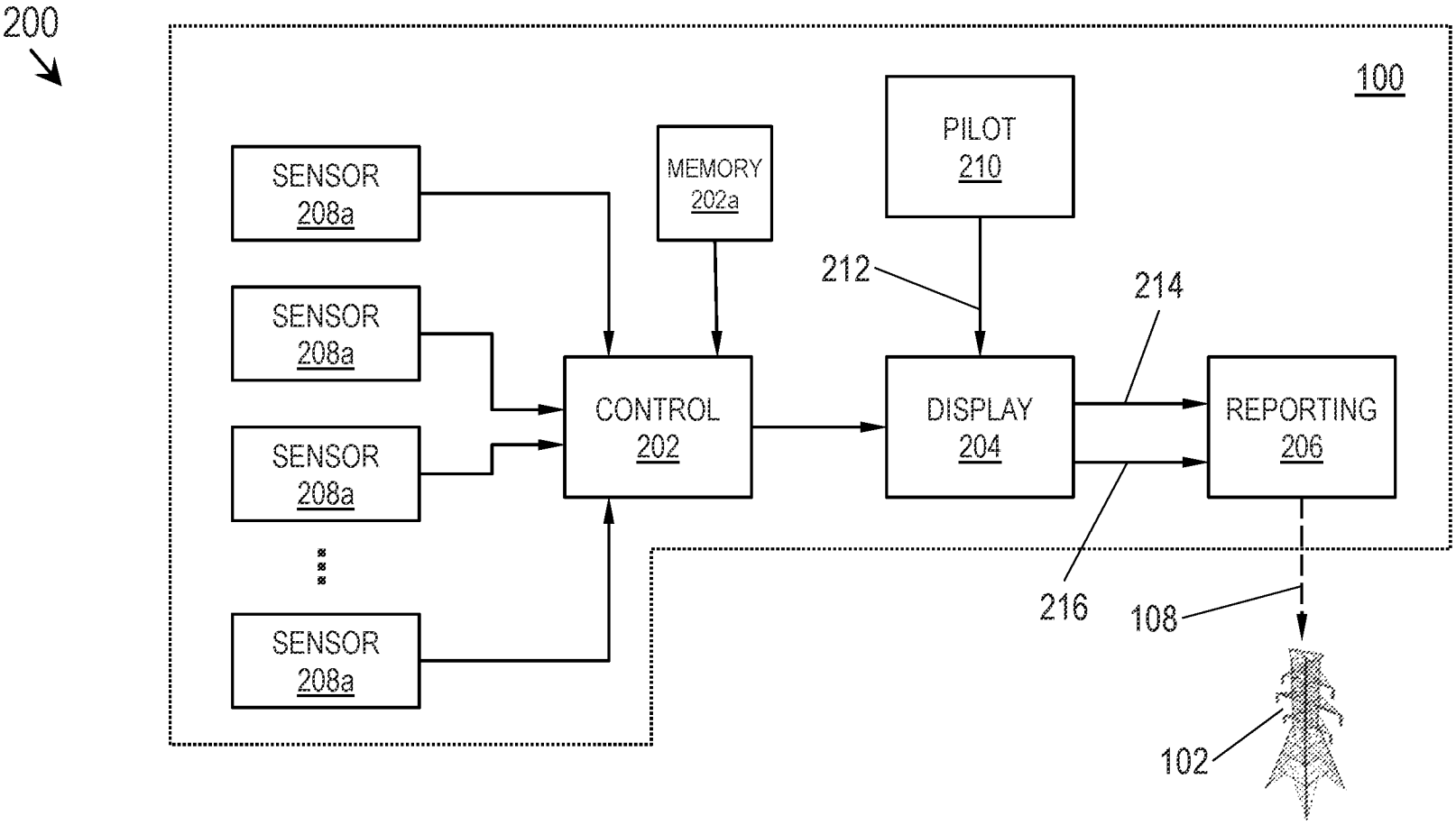
FIG. 2 is a block diagram of a sensor-enhanced real-time automatic PIREP generation system of the aircraft of FIG. 1.

Referring now to FIG. 2, the sensor-enhanced real-time automatic PIREP generation system 200 is shown. The PIREP generation system may include control processors 202, an interactive display device 204, and a reporting module 206.

In embodiments, the PIREP generation system 200 may receive atmospheric data from a variety of aircraft-based sensors 208*a*, 208*b*, 208*c*, . . . 208*n*. For example, the aircraft-based sensors 208*a-n* may include, but are not limited to, a pitot static system, weather radar system, thermometer, barometer, altimeter, airspeed sensor, humidity sensor, anemometer, satellite-based position receiver (e.g., capable of determining a precise aircraft position corresponding to a given data reading), chronometer (e.g., capable of timestamping a given data reading). Broadly speaking, the PIREP generation system 200 may be scalable up or down depending on the size and complexity of the embodying aircraft, but the robustness of the system may be directly related to the number or diversity of aircraft-based sensors 208*a-n* with which the system communicates.

In embodiments, the control processors 202 may analyze incoming datasets alone and in combination to determine if conditions associated with a reportable meteorological event (106, FIG. 1) are present. For example, the control processors (via, e.g., onboard thermometers) may note air temperature not inconsistent with the current altitude; however, air temperature below freezing in conjunction with high humidity (via, e.g., humidity sensors) may indicate conditions conducive to icing. Accordingly, the control processors 202 may determine that reportable conditions occur, forwarding the reportable data points to the interactive display device 204 for display. In some embodiments, the control processors 202 may make predictive conclusions based on one or more data points sharing a common or proximate timestamp. For example, if temperatures are observed to be low but gradually increasing over time, the control processors 202 may determine a current risk of icing that may decline as the aircraft 100 proceeds along its flight plan. Similarly, the control processors 202 may classify, group, evaluate, or make predictive conclusions based on data points sharing a common location or altitude, or having proximate locations or altitudes.

In embodiments, the control processors 202 may present any reportable observations to the pilot (210), soliciting control input (212) before a PIREP is generated or transmitted. For example, the control processors 202 may display reportable datasets and/or conclusions based on analysis thereof to the pilot 210 as plain English text (e.g., or any other applicable operating language) rather than PIREP-formatted.

In embodiments, the PIREP generation system 200 may operate on an opt-out basis rather than an opt-in basis to promote timely and frequent reporting, automatically formatting and reporting any reportable data or conclusions unless the pilot 210 expressly requests otherwise. Similarly, the PIREP generation system may present the pilot 210 with a plain language summary of the reportable data, conditions, or conclusions as opposed to a PIREP in an encoded or formatted state. For example, when reportable data is presented to the pilot 210 via the interactive display device, the PIREP generation system 200 may activate a countdown timer and present the pilot with the opportunity to accept the reportable data as is, amend the reportable data, or reject the reportable data. If the pilot 210 accepts, the reportable data is forwarded (214) to the reporting module 206 for PIREP formatting. If the pilot 210 wishes to amend the reportable data, the amended data is also forwarded (216) to the reporting module 206 for PIREP formatting. If the timer expires with the pilot having taken no action, the reportable data is also forwarded (214) to the reporting module 206 for PIREP formatting. Only when the pilot 210 explicitly rejects the reportable data before the timer expires is no further action taken by the PIREP generation system 200.

Figure 3:
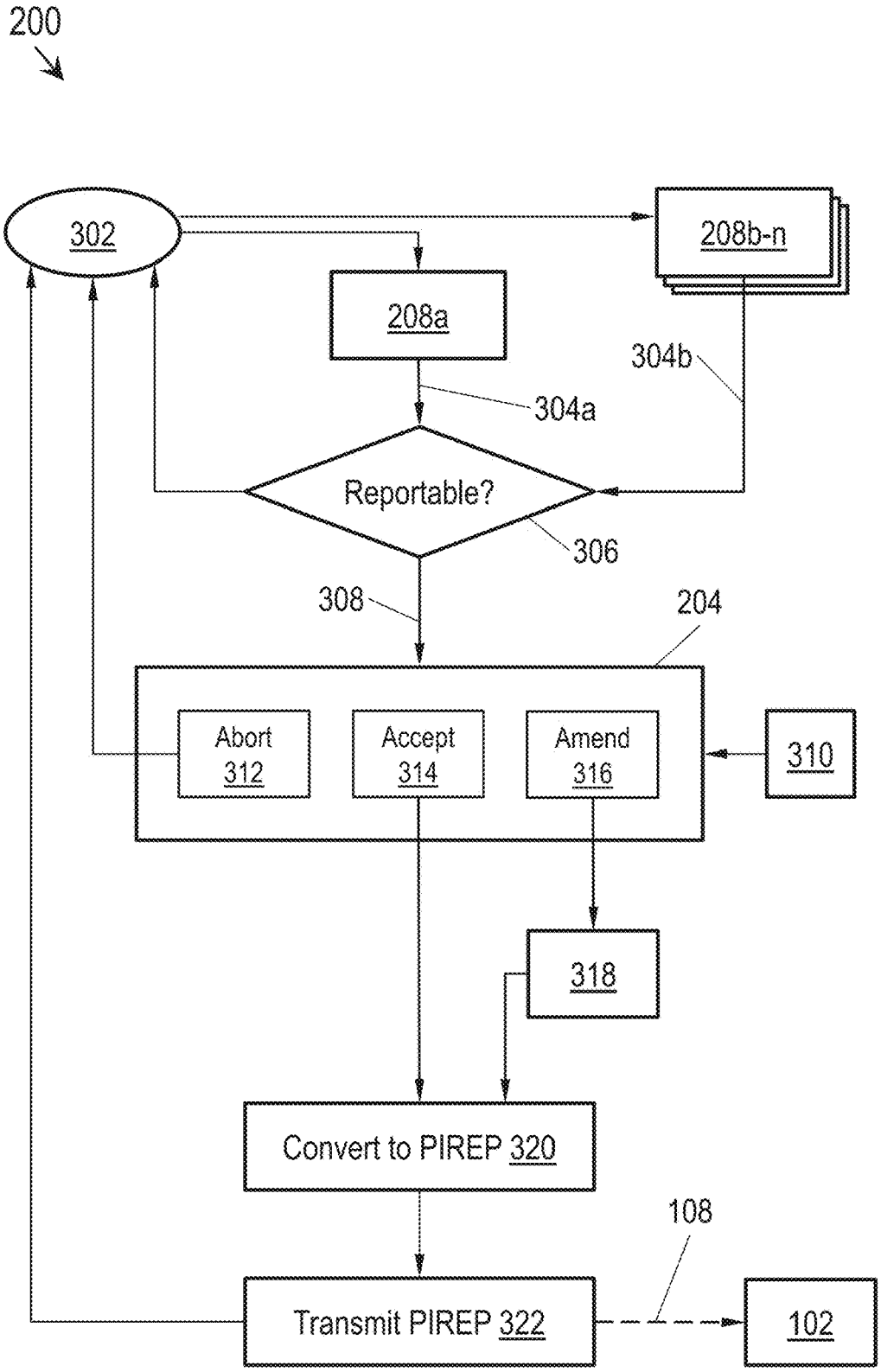
FIG. 3 is a process flow diagram illustrating operations of the PIREP generation system of FIG. 2.

Referring now to FIG. 3, the PIREP generation system 200 is disclosed.

In embodiments, the PIREP generation system 200 may operate in an initial or default state 302. For example, while in the initial state, the control processors (202, FIG. 2) may continually "listen" to aircraft sensors 208*a-b*, reviewing timestamped atmospheric data for datasets (304*a*) or combinations of datasets indicative of reportable conditions (e.g., a meteorological event (106, FIG. 1)). A dataset 304*a* received from a humidity sensor 208*a* (e.g., indicating excessive humidity in the vicinity of the aircraft (100, FIG. 1)) may not by itself indicate reportable conditions, and the PIREP generation system 200 may decide (306) that reportable conditions do not exist, reverting to the initial state 302. However, in embodiments, the PIREP generation system 200 may consider the dataset 304*a* with a contemporaneous dataset 304*b* (received from a temperature sensor 208*b*) indicating air temperatures below freezing, the two datasets in combination indicating the potential for icing, which the PIREP generation system may decide (306) to interpret as a reportable condition.

In embodiments, the PIREP generation system 200 may forward the reportable data (308) to the display device 204 for presentation to the pilot (210, FIG. 2). For example, the display device 204 may present to the pilot 210, rather than an encoded and formatted PIREP, a plain language summary of the reportable data 308. When the reportable data 308 is presented to the pilot 210, the countdown timer 310 may activate, providing the pilot with a time window in which to abort the PIREP (312), accept a PIREP based on the reportable data (314), or amend the reportable data and submit a PIREP based on the amended data (316). For example, the pilot 210 may elect to abort (312) the reportable data 308 if, e.g., the reportable conditions do not align with the pilot's experience and observations; this allows the pilot to maintain quality control over potential PIREPs.

In embodiments, if the pilot 210 elects to abort the PIREP (312), the PIREP generation system 200 may revert to the initial state 302. However, the pilot 210 may wish to amend (316) the reportable data 308, e.g., by adding additional observations or impressions (318) with respect to cloud and sky cover, visibility, turbulence, winds, or any other remarks compatible with a PIREP. In this way the pilot 210 may refine the captured reportable data 308 with other relevant information and/or a human interpretation of the underlying meteorological conditions.

In embodiments, when the countdown timer 310 expires and the pilot 210 has not aborted (312) the reportable data 308, the reporting module (206, FIG. 2) may convert (320) the reportable data (including any observations 318 added by the pilot, if the reportable data has been amended (316)) to PIREP format. For example, any reportable data 308 or additional impressions 318 may be encoded in a format compatible with PIREPs in the appropriate airspace (PIREP formatting over different countries may vary according to, e.g., fields, measurements, or terms in use). The reporting module 206 may add any mandatory elements to the formatted PIREP, e.g., timestamping; location information and flight level (FL; e.g., altitude above ground); aircraft type; urgency identifier (routine or severe).

In embodiments, when the formatted PIREP is completed, the reporting module 206 may transmit (108) the PIREP to proximate ground control facilities (102, FIG. 1). For example, PIREP transmission may occur via Aircraft Communications, Addressing, and Reporting System (ACARS) or any other appropriate digital datalink to ground control facilities (102, FIG. 1). When the PIREP has been transmitted, the PIREP generation system 200 may revert to the initial state 302, e.g., until reportable conditions are again detected.

In some embodiments the PIREP generation system 200 may note subsequent significant changes in atmospheric conditions (e.g., from a time $T_N$ to a subsequent time $T_{N+1}$) as reportable conditions, even if either the initial or subsequent conditions represent nominal and non-severe atmospheric conditions. For example, the PIREP generation system 200, having decided (306) at an initial time $T_N$ that reportable conditions exist, and without regard to whether the reportable data 308 was accepted (314) or amended (316) into a transmitted PIREP (322) at time $T_N$, may subsequently (e.g., based on changes in aircraft altitude or in the surrounding atmospheric conditions) observe at the time $T_{N+1}$ that atmospheric conditions have returned to a nominal or non-severe state. This change in conditions may be due to a change in weather patterns and/or the result of a change in heading and/or altitude on the part of the aircraft 100. Even though the weather in the vicinity of the aircraft may have returned to a relatively normal (e.g., not otherwise reportable) state, the PIREP generation system 200 may note the significant change in meteorological conditions as reportable data (308) to be submitted to the pilot 210. In embodiments, the PIREP generation system 200 may similarly note the persistence of reportable meteorological conditions from the time $T_N$ to the subsequent time $T_{N+1}$ (e.g., despite any changes in altitude, heading, and/or position on the part of the aircraft 100) by submitting reportable data 308 based on persistent meteorological conditions to the pilot 210.

Figure 4:
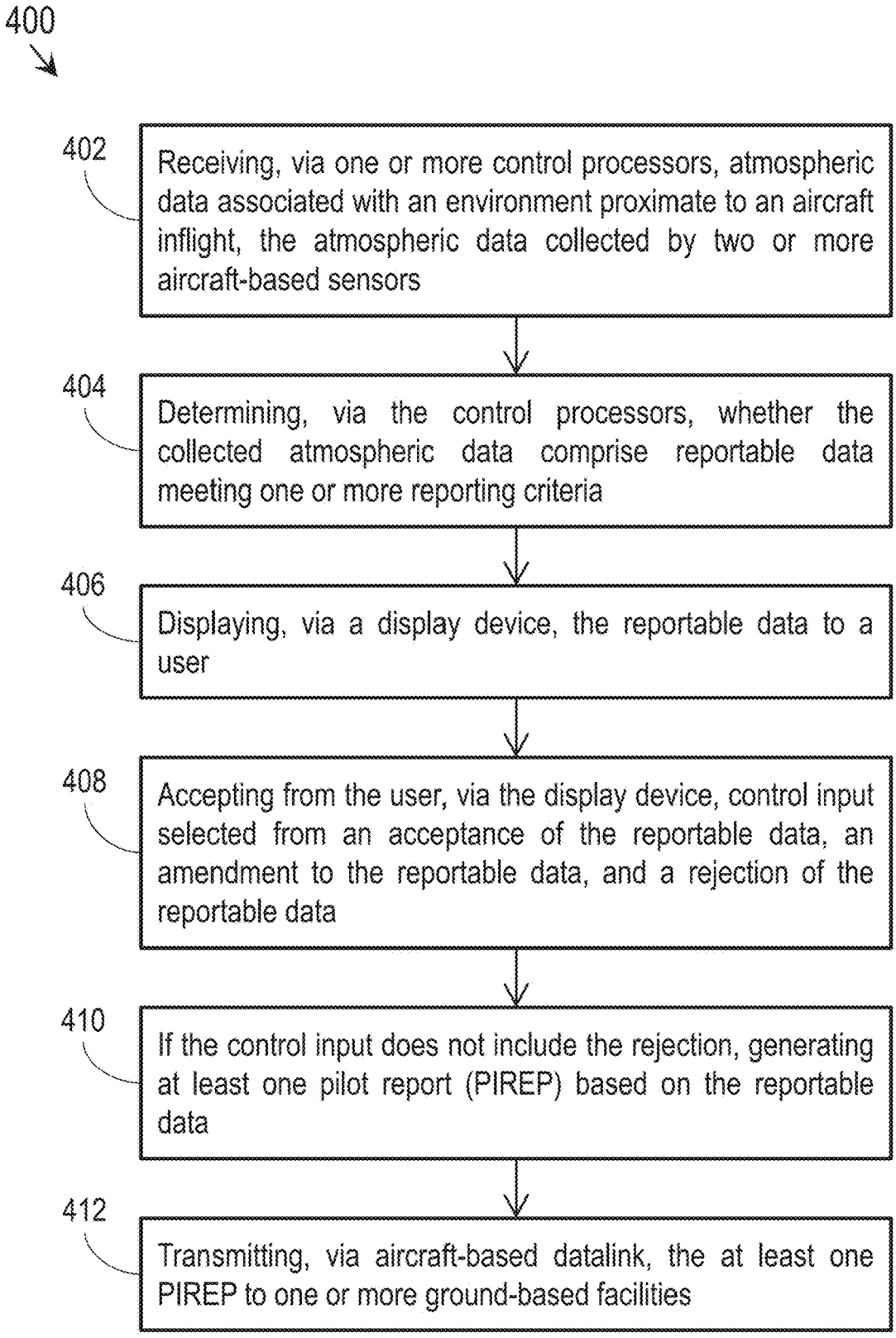
FIG. 4 is a flow diagram illustrating a method for sensor-enhanced real-time automatic PIREP generation according to example embodiments of this disclosure.

Referring now to FIG. 4, the method 400 may be implemented by the sensor-enhanced real-time automatic pilot report (PIREP) generation system 200 and may include the following steps.

At a step 402, the PIREP generation system receives atmospheric data associated with an environment proximate to an aircraft, the atmospheric data collected by two or more aircraft-based sensors. In some embodiments, the atmospheric data may include sequential datasets, e.g., a first dataset corresponding to a first timestamp or a first location or altitude of the aircraft and a subsequent dataset corresponding to a future or subsequent timestamp, or to a future position or altitude of the aircraft.

At a step 404, the PIREP generation system determines whether the received atmospheric data constitute reportable conditions (e.g., associated with a meteorological event) according to one or more reporting criteria. For example, reportable conditions may be identified based on an analysis of multiple contemporaneous datasets collected by multiple, diverse sensors. In embodiments, the presence of reportable conditions may be determined based one or more conditions reaching a threshold level (e.g., temperature, humidity) as measured by their individual sensors. For example, reporting criteria may provide that reportable conditions exist, or for the generation of reportable data, based on a significant change in conditions (e.g., if atmospheric or meteorological conditions become severe or significant enough to be reportable, or if severe or significant conditions revert to a normal, default, or otherwise non-reportable state). Alternatively, or additionally, reporting criteria may provide that reportable conditions exist based on a persistence of severe or significant atmospheric or meteorological conditions through the passage of time (e.g., sequential timestamps) or throughout changes in location and/or altitude on the part of the aircraft.

At a step 406, the display device presents the reportable data to the pilot. For example, the display device may be presented and a countdown timer activated, opening a time window for the pilot to act on the presented reportable data.

At a step 408, the display device accepts control input from the pilot. The control input may represent the pilot's acceptance of the reportable data as presented, the pilot's intent to amend the reportable data, or the pilot's rejection of the reportable data.

At a step 410, if the accepted control input does not include the pilot's rejection of the reportable data, the PIREP generation system formats and encodes one or more PIREPs based on the reportable data. For example, if the pilot has accepted the reportable data, the PIREP will be formatted based on the reportable data as presented. In some embodiments, the pilot elects to amend or augment the reportable data, and therefore the PIREP will be formatted based on the reportable data as amended or revised by the pilot. In some embodiments, the pilot takes no action, and therefore the PIREP will be formatted based on the reportable data as presented once the countdown timer has expired.

At a step 412, the PIREP generation system transmits the formatted and encoded PIREP to proximate ground-based facilities.

CONCLUSION

It is to be understood that embodiments of the methods disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

Although inventive concepts have been described with reference to the embodiments illustrated in the attached drawing figures, equivalents may be employed and substitutions made herein without departing from the scope of the claims. Components illustrated and described herein are merely examples of a system/device and components that may be used to implement embodiments of the inventive concepts and may be replaced with other devices and components without departing from the scope of the claims. Furthermore, any dimensions, degrees, and/or numerical ranges provided herein are to be understood as non-limiting examples unless otherwise specified in the claims.

I claim:

1. A sensor-enhanced real-time automatic pilot report (PIREP) generating system, comprising:

at least one control processor in communication with the aircraft-based sensors, the control processor configured to:

receive, from two or more aircraft-based sensors, atmospheric data proximate to a location of an aircraft in flight;

and determine whether the collected atmospheric data meet one or more reporting criteria;

an interactive display device in communication with the control processor and comprising:

a display configured to, if the collected atmospheric data meets the reporting criteria, display the atmospheric data to a user;

an input device configured to accept control input from the user, the control input selected from an acceptance of the displayed atmospheric data, an amendment to the displayed atmospheric data, and a rejection of the displayed atmospheric data;

and a reporting module in communication with the control processors and the display device, the reporting module configured to:

activate a countdown timer when the collected atmospheric data are displayed;

and when the countdown timer expires and control input including a rejection of the displayed atmospheric data is not received:

if no control input is received or the control input includes an acceptance of the displayed atmospheric data, generate at least one pilot report (PIREP) based on the displayed atmospheric data;

if the control input includes an amendment to the displayed atmospheric data, generate the at least one PIREP based on the amended atmospheric data;

and transmit the at least one PIREP to one or more ground-based facilities.

2. The sensor-enhanced PIREP generating system of claim 1, wherein the displayed atmospheric data and the amendment are associated with a text format.

3. The sensor-enhanced PIREP generating system of claim 1, wherein:

the collected atmospheric data include at least a first dataset and a second dataset;

and the reporting criteria are associated with at least one of:

a threshold change of one or more conditions between the first dataset and the second dataset;

or a persistence of reportable conditions between the first dataset and the second dataset.

4. The sensor-enhanced PIREP generating system of claim 3, wherein the first dataset is associated with a first timestamp and the second dataset is associated with a subsequent timestamp.

5. The sensor-enhanced PIREP generating system of claim 3, wherein the first dataset is associated with a first location and the second dataset is associated with a subsequent location.

6. The sensor-enhanced PIREP generating system of claim 5, wherein the first location corresponds to a first altitude and the second location corresponds to a subsequent altitude.

7. The sensor-enhanced PIREP generating system of claim 1, wherein the displayed atmospheric data include at least one predictive data element generated by the control processor based on the collected atmospheric data.

8. A method for sensor-enhanced real-time automatic pilot report (PIREP) generation, the method comprising:

receiving, via one or more control processors, atmospheric data associated with an environment proximate to an aircraft inflight, the atmospheric data collected by two or more aircraft-based sensors;

determining, via the control processors, whether the collected atmospheric data comprise reportable data meeting one or more reporting criteria;

displaying, via a display device, the reportable data to a user;

activating, via the display device, a countdown timer;

accepting from the user, via the display device, control input selected from an acceptance of the reportable data, an amendment to the reportable data, and a rejection of the reportable data;

if, when the countdown timer expires and control input including a rejection of the reportable data is not received, generating at least one pilot report (PIREP) based on the reportable data;

and transmitting, via aircraft-based datalink, the at least one PIREP to one or more ground-based facilities.

9. The method of claim 8, wherein generating at least one PIREP based on the reportable data includes:

if the control input includes an amendment to the reportable data, generating the at least one PIREP based on the displayed reportable data and the amendment.

10. The method of claim 8, wherein collecting, via one or more aircraft-based sensors, atmospheric data associated with an environment proximate to an aircraft inflight includes collecting at least a first dataset via a first sensor and a second dataset via a second sensor;

and determining, via one or more control processors, whether the collected atmospheric data comprises reportable data meeting one or more reporting conditions includes generating at least one predictive data element based on the first dataset and the second dataset.

11. The method of claim 8, wherein:

collecting, via one or more aircraft-based sensors, atmospheric data associated with an environment proximate to an aircraft inflight includes collecting at least a first dataset and a subsequent dataset;

and determining, via one or more control processors, whether the collected atmospheric data comprises reportable data meeting one or more reporting conditions includes identifying at least one of 1) a threshold change in conditions between the first dataset and the subsequent dataset or 2) a persistence of reportable conditions between the first dataset and the subsequent dataset.

12. The method of claim 11, wherein collecting, via one or more aircraft-based sensors, atmospheric data associated with an environment proximate to an aircraft inflight includes collecting at least a first dataset and a subsequent dataset includes collecting at least a first dataset associated with a first time and a subsequent dataset associated with a subsequent time.

13. The method of claim 11, wherein collecting, via one or more aircraft-based sensors, atmospheric data associated with an environment proximate to an aircraft inflight includes collecting at least a first dataset and a subsequent dataset includes collecting at least 1) a first dataset associated with at least one of a first location and a first altitude and 2) a subsequent dataset associated with at least one of a subsequent location and a subsequent altitude.

* * * * *